United States Patent [19]

Adelman

[11] Patent Number: 5,028,390

[45] Date of Patent: Jul. 2, 1991

[54] NIOBIUM-BASED SUPERALLOY COMPOSITIONS

[76] Inventor: Stuart L. Adelman, 651 Cole St., Apt. 4, San Francisco, Calif. 94117

[21] Appl. No.: 385,405

[22] Filed: Jul. 27, 1989

[51] Int. Cl.[5] ..... C22C 27/02

[52] U.S. Cl. ..... 420/425; 420/426; 148/422

[58] Field of Search ..... 420/425, 426; 148/422

[56] References Cited

PUBLICATIONS

Chem Abstract 80(12):62755k, 1980.
Chem Abstract 77(26):169821u, 1977.

*Primary Examiner*—R. Dean
*Assistant Examiner*—Margery S. Phipps
*Attorney, Agent, or Firm*—Watson, Cole, Grindle & Watson

[57] ABSTRACT

A superalloy composition comprising niobium, an element selected from the group consisting of rhenium and technetium, and, optionally, an element selected from the lanthanide and actinide series, scandium, yttrium and lanthanum.

17 Claims, No Drawings

NIOBIUM-BASED SUPERALLOY COMPOSITIONS

FIELD OF THE INVENTION

The present invention relates generally to the field of eutectic superalloys and additionally to their use in airplane and aeroengine components in aerospace vehicles. More specifically, it relates to refractory superalloys, most specifically, those based on niobium.

BACKGROUND OF THE INVENTION

Nickel-based superalloys are well-known in the art. They generally consist of a class of materials which solidify from the molten state according to monovariant eutectic reactions and provide aligned polyphase structures including such systems as the ternary and quaternary alloys identified as nickel-chromium-carbon and nickel-titanium-chromium-iron. Such compositions provide advantages and, in fact, are the subject of my copending application Ser. No. 347,677, filed May 5, 1989. As used in the present application, the term, superalloy, will be used to refer to high temperature alloys which melt at approximately 2500° F. or more. Nickel, for example, melts at about 2500° F.

Such nickel-based alloys are known to the prior art and are particularly useful, not only for their high melting points, but because after solidification, they may exhibit unusual strength. In particular, as disclosed in U.S. Pat. No. 4,111,723 to Lemkey et al., by means of directional solidification of a nickel-chromium-carbon alloy, chromium carbide fibers may be formed during the transition from the molten phase, which results in imparting great strength to the cooled alloy.

Niobium and its alloys exhibit properties that provide technological capabilities of great importance among the refractory metals. The advantages of niobium as compared with other refractory metals can be summarized as follows: the density, 8.57 gm/cc., and the thermal neutron absorption cross-section, 1.1 barns, of niobium are the lowest of the refractory metals. Its cryogenic ductility and ease of fabrication are excellent. Niobium oxidizes non-catastrophically; it is superior to both molybdenum and tungsten in this respect. It is in abundant supply; it is estimated that the accessible world reserves of niobium probably exceed those of molybdenum.

Although niobium is a ductile, soft metal at elevated temperatures, its strength can be improved by alloying to make it competitive with and superior to molybdenum and molybdenum alloys, its closest rival for use at temperatures in excess of 1500° C. (2700 ° F.). The advantages of niobium alloys may well dictate their preferred use over other refractory metals in elevated temperature environments as high as 1850° C. However, lack of oxidation resistance has been a major barrier to the use of niobium alloys in structural applications at high temperatures.

Initial studies of niobium alloys were directed to overcoming niobium's poor oxidation resistance. In common with other refractory metals, niobium and its alloys tend to oxidize in air at high temperatures, and this has seriously impaired its usefulness in elevated temperature applications. The chemical process is both complex and variable, involving repeated changes from linear to parabolic and vice versa, but although the chemical process is highly complicated, the transformation from the metal to the oxide state causes obvious thinning and concomitant weakening of the metallic structure.

Probably more significant than oxide formation is the high rate of diffusion of oxygen into the metallic structure, which produces regions of embrittlement. In point of fact, niobium can suffer as much as 70 percent loss of ductility with as little as 15 percent of its cross-sectional depth contaminated with oxygen. Indeed, that degree of contamination can be achieved in air within one minute at 1100 ° C. Alloying will improve niobium's resistance to oxidation weakening, but no elemental additives have been found which provide specific, enhanced protection against both effects.

As a result, while niobium has a melting point of about 3500° F., 1000° F. higher than the melting point of nickel, lack of oxidation resistance and less mechanical strength that might be desired have hindered the use of niobium as the base for a superalloy composition.

It is, therefore, a primary object of the present invention to provide a niobium-based superalloy composition in which the superalloy has enhanced mechanical properties over niobium, owing both to structural strengthening and to inhibition of oxygen weakening.

SUMMARY OF THE INVENTION

In accordance with the present invention, a niobium-based superalloy composition consist of at least two materials: niobium and an additive element selected from the group consisting of rhenium, technetium, and mixtures thereof. Preferably, a third element is also present: one selected from the set consisting of an element of the lanthanide and actinide series of the periodic table, as well as scandium, yttrium, lanthanum, and mixtures thereof. In such a composition the last mentioned element is present in about 0 to 1 percent, and the additive element, rhenium, technetium and mixtures thereof, is present from about 0.001 to 10 percent by weight.

Within these parameters, certain preferences will be found. Thus, of the additive element which consists of rhenium, technetium and mixtures thereof, rhenium is preferred, not only does rhenium appear to be superior to technetium in imparting strength to the niobium-based alloy, but it is far less expensive than technetium. When rhenium is present, it is present in about 2 to 10 percent by weight, more preferably 5 to 7 percent of the total composition. When technetium is present, it is present at the lower end of the amount specified, i.e., about 0.001 to 0.1 weight percent.

Other elements of the composition are preferred, based on price, availability and functionality. Thus, of the first elements, i.e., those from the lanthanide and actinide series as well as scandium, yttrium, and lanthanum, scandium appears to be more readily adaptable to the present invention. The presence of other elements, for example, zirconium, aluminum and either carbon or boron or both, are advantageously present, according to the specific alloy to be produced. Of course, each of these additional elements has ranges, generally up to about 2 percent by weight, and an optimum percent so far as presently understood.

These and other objects, features an advantages of my invention will be better understood when that invention is considered in conjunction with a detailed description of the best mode of the invention as presently contemplated by me, which description is set forth hereinbelow.

DETAILED DESCRIPTION OF PREFERRED EMBODIMENTS

As I understand the best mode of my invention at this time, it has a basic composition, with ranges specified, as: an element from the lanthanide and actinide series of the periodic table, scandium, yttrium, lanthanum, and mixtures thereof—0 to 1 percent, an element selected from the group consisting of rhenium, technetium and mixtures thereof—0.001 to 10 percent, and niobium constituting essentially the balance of the composition.

More preferably, I view the best mode of my invention at the present time as constituting the following composition: scandium—0.5 percent, rhenium—6 percent, carbon—1 percent, zirconium—1 percent, aluminum—2 percent, with the balance essentially niobium.

In above preferred embodiments and elsewhere in this disclosure and claims, where it is stated that the balance is essentially niobium, means that even other elements, including impurities such as iron, are present in the final composition, if such elements are not present in amounts that will significantly detract from the corrosion resistance and/or mechanical strength of the niobium alloy, such elements are still to be included with the composition. Expressed otherwise, the presence of such other materials does not diminish the statement that the balance is essentially niobium.

The present invention provides superalloys having greatly improved mechanical properties. The addition of rhenium and/or technetium to a niobium base provides a surprising and unexpected result which can be quantified, in part, by an increase in time of several thousand hours to stress rupture at temperatures in excess of 1000° C. This unexpected increase permits the use of the improved niobium superalloy in gas turbine engine component manufacture because of its enhanced resistance to failure under stress at high temperatures. For the same reason, the improved superalloy is useful in the manufacture such components as the shell of the combustion chamber in a supersonic combustion ramjet (SCRAMjet) as well as in the manufacture of airframe components, which necessitate resistance to very high temperatures of frictional skin heating during such flight stages as atmospheric re-entry or intra-atmospheric hypersonic flight. Another surprising and unexpected result of the claimed alloy is its greatly improved resistance to embrittlement as well as the fact that the order of magnitude increase in desirable mechanical properties can be obtained without a corresponding order of magnitude increase in the cost of the improved superalloy.

My improved superalloy composition appears to have enhanced mechanical properties owing both to structural strengthening and to the inhibition of oxygen weakening where both effects are attainable by use of the properties of the Group VIIB metals, rhenium and technetium. Local segregates of the solute result in the formation of atmospheres of short-range ordering in which the movement of dislocations through the matrix crystals is impeded by those strained regions characterized by the clustering of atoms with differing atomic radii. Clearly, solid solution strengthening will be greatest for solutes whose atomic radii are most different from those of the solvent. Similarly, those elements which have the highest melting points will display the lowest diffusivity and consequently the highest thermal stability.

Multiphase strengthening is also obtainable with this improved superalloy. It is predicted that technetium and rhenium will precipitate out of solid solution and segregate to a topological close-packed, or geometric close-packed phase; moreover, if directional solidification is optionally employed as a fabrication technique, rhenium and technetium will also segregate to a carbide fiber phase, providing dramatically enhanced resistance to high-temperature creep, a wholly surprising and unexpected result when dealing with niobium-based refractory superalloys. It is further predicted that the addition of refractory metal oxides, oxides of the lanthanide elements or oxides of the actinide elements as oxide dispersion strengtheners (ODS) will further enhance the superalloys elevated-temperature mechanical properties.

It is notable that in addition to the extraordinary effect which the addition of rhenium and technetium have on the enhancement of mechanical properties with regard to solid-solution strengthening (solute blocking) in consequence of their atomic diameters, the addition of small amounts of technetium carries with it the added bonus of providing, simultaneously, a remarkable corrosion resistance, thus overcoming a traditional and well known stumbling block to the high temperature use of refractory metal alloys. These results are not believed to be obvious from the prior art and the consequent dramatic increases in mechanical properties and corrosion resistance provide a surprising and unexpected result. The improved superalloy described herein is at least warm-workable and, it is believed amenable to hot-working without any significant loss of desirable mechanical properties. Similarly, it may be fabricated by such powder metallurgical techniques as hot isostatic pressing (HIP).

It will be apparent that certain modifications and alterations in the above set forth, detailed description of my invention will be obvious to those of ordinary skill in this art. As to all such modifications and alterations, it is desired that they be included within the purview of my invention. which is to be limited only by the scope, including equivalents, of the following, appended claims, in which all percentages are by weight.

I claim:

1. A niobium-based superalloy composition consisting essentially of 0 to 1 percent of a corrosion inhibitor-mechanical strengthener selected from the group consisting of an element from the lanthanide and actinide series of the periodic table, scandium, yttrium, lanthanum, and mixtures thereof; 0.001 to 10 percent of an additive element selected from the group consisting of rhenium, technetium, and mixtures thereof; and the balance of said superalloy composition being essentially niobium, said superalloy composition having improved resistance to high temperature oxidation of its niobium content.

2. A niobium-based superalloy composition as claimed in claim 1, in which said additive element is rhenium.

3. A niobium-based superalloy composition as claimed in claim 2, in which said rhenium is present in about 2 to 10 percent.

4. A niobium-based superalloy composition as claimed in claim 3, in which said rhenium is present in about 5 to 7 percent.

5. A niobium-based superalloy composition as claimed in claim 1, in which said additive element is technetium.

6. A niobium-based superalloy composition as claimed in claim 5, in which said technetium is present in about 0.001 to 0.1 percent.

7. A niobium-based superalloy composition as claimed in claim 1, in which said corrosion inhibitor-mechanical strengthener is scandium.

8. A niobium-based superalloy composition as claimed in claim 7, in which said scandium is present in about 0.2 to 0.7 percent.

9. A niobium-based superalloy composition as claimed in claim 1, in which said corrosion inhibitor-mechanical strengthener is scandium and said additive element is rhenium.

10. A niobium-based superalloy composition as claimed in claim 1, in which said corrosion inhibitor-mechanical strengthener is erbium.

11. A niobium-based superalloy composition as claimed in claim 1, in which said corrosion inhibitor-mechanical strengthener is thorium.

12. A niobium-based superalloy composition consisting essentially of 0 to 2 percent zirconium; 0 to 2 percent of a fiber-forming element selected from the group consisting of carbon and boron and mixtures thereof; 0 to 2 percent aluminum; 0 to 1 percent of a corrosion inhibitor-mechanical strengthener selected from the group consisting of the elements of the lanthanide and actinide series of the periodic table, scandium, yttrium, lanthanum, and mixtures thereof; 0.001 to 10 percent of an additive element selected from the group consisting of rhenium, technetium and mixtures thereof; and the balance essentially niobium, said superalloy composition having improved resistance to high temperature oxidation compared to niobium alone.

13. A niobium-based superalloy composition as claimed in claim 11, in which said zirconium is present in about 1 percent.

14. A niobium-based superalloy composition as claimed in claim 11, in which said fiber forming element is carbon.

15. A niobium-based superalloy composition as claimed in claim 12, in which said carbon is present in about 1 percent.

16. A niobium-based superalloy composition consisting essentially of approximately 1 percent zirconium, 2 percent aluminum, 1 percent carbon, 0.5 percent scandium 0.001to 10 percent of an additive element selected from the group consisting of rhenium, technetium and mixtures thereof; and the balance essentially niobium, said superalloy composition having improved resistance to high temperature oxidation compared to niobium alone.

17. A niobium-based superalloy composition as claimed in claim 15, in which said additive element is rhenium.

* * * * *